US012551077B1

(12) United States Patent
Grigoryan et al.

(10) Patent No.: US 12,551,077 B1
(45) Date of Patent: Feb. 17, 2026

(54) HAND SANITIZER SPONGE

(71) Applicant: Vahe Grigoryan, La Crescenta, CA (US)

(72) Inventors: Vahe Grigoryan, La Crescenta, CA (US); Vardan Grigoryan, La Crescenta, CA (US)

( * ) Notice: Subject to any disclaimer, the term of this patent is extended or adjusted under 35 U.S.C. 154(b) by 0 days.

(21) Appl. No.: 19/257,343

(22) Filed: Jul. 1, 2025

(51) Int. Cl.
*A47L 13/17* (2006.01)

(52) U.S. Cl.
CPC ..... *A47L 13/17* (2013.01)

(58) Field of Classification Search
CPC ..... A47L 13/17; A45D 34/00
See application file for complete search history.

(56) References Cited

U.S. PATENT DOCUMENTS 6,890,115 B2 * 5/2005 Le Moing ..... A45D 40/02 401/266
8,533,887 B2 * 9/2013 Hirst ..... A61L 2/18 15/104.94
2018/0323535 A1 * 11/2018 Hughes ..... H01R 13/5213

FOREIGN PATENT DOCUMENTS

CA 3140771 A1 * 12/2020 ..... B65D 50/00

* cited by examiner

*Primary Examiner* — Shay Karls
(74) *Attorney, Agent, or Firm* — Phil IP Law Inc.; Karen K. Galoyan; Narek Zohrabyan

(57) ABSTRACT

A portable hand sanitizer sponge device comprises a container for holding sanitizing liquid, a sponge element having an upper conical frustum part and a lower cylindrical part for retaining and dispensing the liquid, a flexible sleeve with a central opening through which the sponge extends, and a lid for hermetically sealing the assembly. The components are threadably connected, with the cylindrical part of the sponge tightly fitted within the container chamber and held in position by the sleeve. A rubber ring seated in a groove provides hermetic sealing between the container and sleeve. In some embodiments, a child-proof locking mechanism includes sleeve lugs on the sleeve and corresponding container lugs on the container, requiring elliptical deformation of the flexible sleeve for disengagement. The device facilitates controlled dispensing of sanitizing liquid through finger pressure on the exposed sponge while maintaining hermetic storage when closed.

5 Claims, 6 Drawing Sheets

HAND SANITIZER SPONGE

BACKGROUND

The disclosure here relates to the field of dispenser, in particular, to a dispenser of a hand sanitizer.

The use of antiseptic, sanitizing agents for preventing infection and controlling the spread of disease has a long and well-documented history. Ancient civilizations utilized rudimentary antiseptic, sanitizing substances such as wine, vinegar, and honey to cleanse wounds. However, the modern era of antisepsis began in the 19th century with the pioneering work of Ignaz Semmelweis and Joseph Lister, who demonstrated that disinfecting hands and surgical tools significantly reduced mortality in clinical settings.

Since then, numerous chemical formulations have been developed for antiseptic purposes, including alcohol-based solutions (e.g., isopropanol and ethanol), iodine-based compounds, hydrogen peroxide, chlorhexidine, and more recently, quaternary ammonium compounds. These antiseptics have become indispensable in both clinical environments and public health initiatives.

In parallel, the evolution of devices designed to dispense antiseptics has played a crucial role in facilitating safe and effective application. Early devices were simple containers with basic lids or spouts. Over time, more advanced sanitizing dispensers were introduced, incorporating pumps, nozzles, and valves to control dosage and prevent contamination. Wall-mounted dispensers, foot-operated units, and automatic sensor-based systems are now commonplace in hospitals, public restrooms, offices, and other high-traffic environments.

Despite these advancements, recent public health crises, including the COVID-19 pandemic, have exposed that challenges remain.

SUMMARY

In accordance with an aspect, there is provided the Hand Sanitizer Sponge device may comprise a container for holding a sanitizing liquid, a sponge for retaining the sanitizing liquid, a sleeve having a central opening through which the sponge extends, and a lid for covering the sponge. The hand sanitizer sponge may include a sleeve that is threaded onto the container, with a lid that may, in turn, be threaded onto the sleeve. The sleeve may feature internal female screw threads configured to engage with corresponding external male screw threads on the container. Likewise, the lid may include internal female threads that engage with external male threads on the outer surface of the sleeve. To enhance sealing, the device may further include a rubber sealing ring positioned between the sleeve and the container. This rubber ring may be seated within a groove formed in an interior section of the sleeve. The sponge used in the device may include a sponge cavity, which may have the shape of an inverted conical frustum—wider at the top and narrower at the bottom. The sponge itself may comprise two portions: an upper part in the shape of a conical frustum and a lower cylindrical part that is integral with the conical frustum portion. The lower cylindrical part may be dimensioned to fit tightly within a chamber of the container, thereby securing the sponge in place. The device may further include a child-proof locking mechanism. This mechanism may comprise at least one sleeve lug positioned on the outer surface of the sleeve and at least one container lug located on the container. Each container lug may include a ramp surface, with a stop surface that is oriented substantially perpendicular to the external sidewall surface of the container. The material of the sleeve may be sufficiently flexible to allow for radial expansion through elliptical deformation when squeezed. This deformation may create enough clearance to enable the sleeve lug to override the height of the container lug. In one embodiment, two sleeve lugs may be positioned diametrically opposite each other on the sleeve, while two container lugs may be correspondingly positioned on the container in a diametrically opposite arrangement.

DESCRIPTION OF THE DRAWINGS

Embodiments in accordance with the present invention are shown in the drawings and will be described below with reference to the figures, whereby elements having the same effect have been provided with the same reference numerals.

The following is shown.

Figure 1:
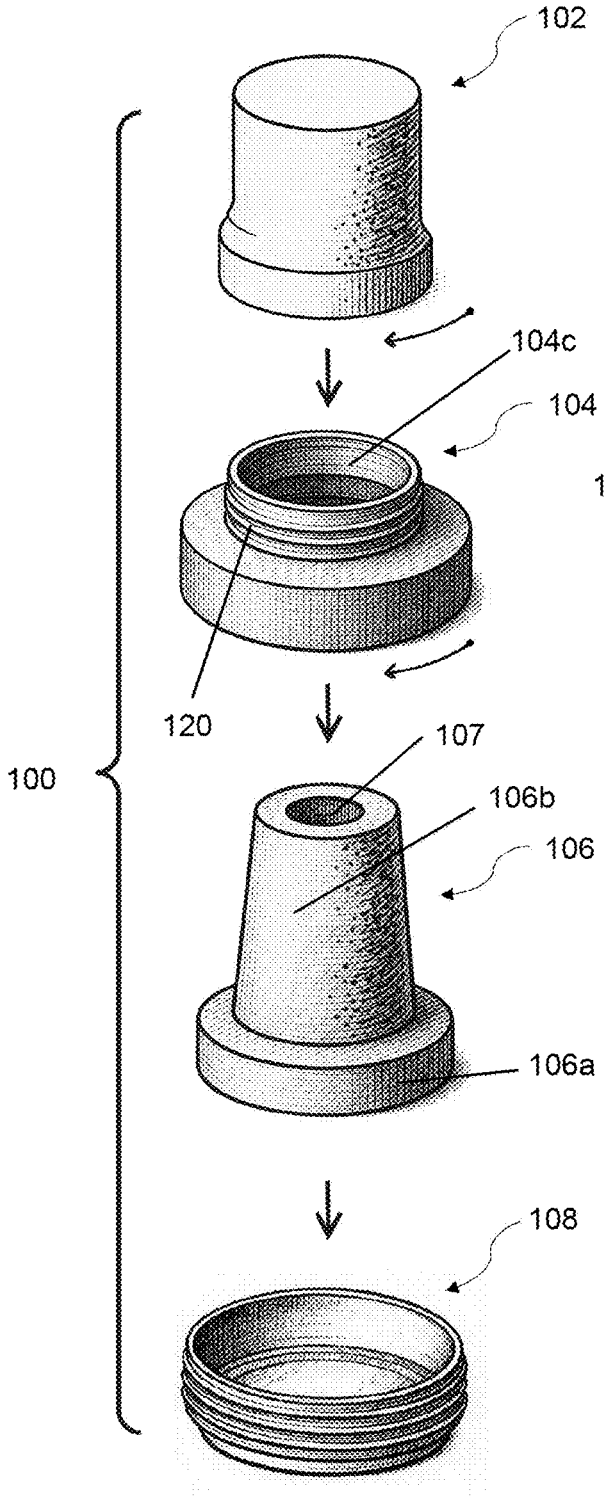
FIG. 1 shows an exploded view of an embodiment of the hand sanitizer sponge.

To facilitate a comprehensive understanding of the hand sanitizer sponge, the following list is not limited but enumerates the reference numerals used throughout the description and drawings.

The list is as follows:

1. Hand Sanitizer Sponge 100
2. Lid 102
3. Sleeve 104
4. Sleeve surface 104*a*
5. Sleeve deforming area 104*b*
6. Sponge 106
7. Cylindrical part of sponge 106*a*
8. Conical frustum part 106*b*
9. Sponge cavity 107
10. Container 108

11. Chamber 108*a*
12. Depression 108*b*
13. Liquid 110
14. Sleeve rubber ring 112
15. Container external male screw threads 116
16. Sleeve internal female screw threads 118
17. Sleeve external male screw threads 120
18. Groove 121
19. Lid internal female screw threads 122
20. Squeeze bottle 124
21. Sleeve lug 105
22. Container lug 109
23. Stop surface 109*a*
24. Ramp Surface 109*b*

DESCRIPTION

Exemplified embodiments are now described. Other embodiments may be used in addition or instead. Details that may be apparent or unnecessary may be omitted to save space or for a more effective presentation. Some embodiments may be practiced with additional components or steps and/or without all of the components or steps that are described.

FIG. 1 exemplifies an exploded view of an embodiment of the hand sanitizer sponge 100. The hand sanitizer sponge 100 incorporates a lid 102, a sleeve 104 having the central opening 104*c*, a sponge 106, having a form of a conical frustum with a wider cylindrical shape base at the bottom (also shown in FIG. 2*c*), and a container 108. The sponge 106 comprises a conical frustum part 106*b* transitioning to a cylindrical part 106*a* at its base, in other words the conical frustum part 106*b* and cylindrical part 106*a* forms a single piece (also shown in FIG. 2*c*). Lid internal female screw threads 122 (shown in FIG. 2*a*) are located on the internal, bottom portion of the lid 102. In FIG. 2*b*, the sleeve external male screw threads 120 are located on the upper part of the sleeve 104. In FIG. 2*d*, the container 108 has container external male screw threads 116, which correspond to the sleeve internal female threads 118, located on the sleeve 104 (shown in FIG. 2*b*).

Figure 2A:
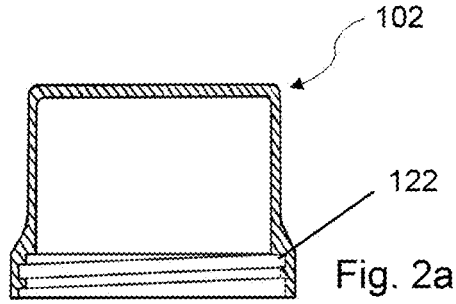
FIG. 2*a* shows a cross-sectional view of the lid.
Figure 2B:
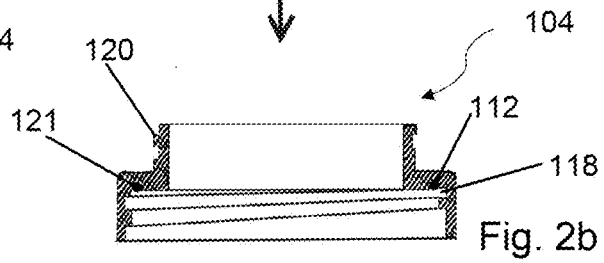
FIG. 2*b* shows a cross-sectional view of the sleeve.

FIG. 2*a* exemplifies a cross-sectional view of the lid 102 of the hand sanitizer sponge 100. The lid internal female screw threads 122 are clearly visible on the inner bottom portion of the lid 102, designed to engage with the sleeve 104 by screwing onto the sleeve external male screw threads 120.

FIG. 2*b* exemplifies a cross-sectional view of the sleeve 104, showing the sleeve external male screw threads 120 on its upper portion and the sleeve internal female screw threads 118 on its lower portion. The sleeve rubber ring 112 may be positioned in the groove 121 to provide hermetic sealing, wherein the groove 121 is located in the interior part of the sleeve 104. In other embodiments of the hand sanitizer sponge 100, the sleeve 104 may not have the groove 121.

Figure 2C:
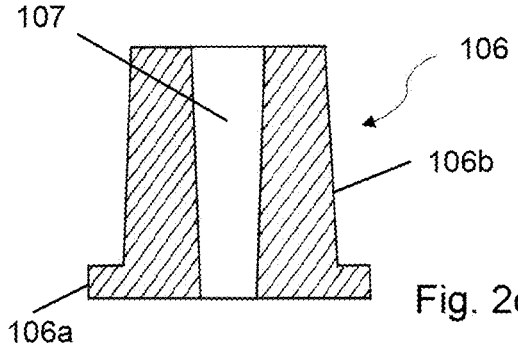
FIG. 2*c* shows a cross-sectional view of the sponge.
Figure 2D:
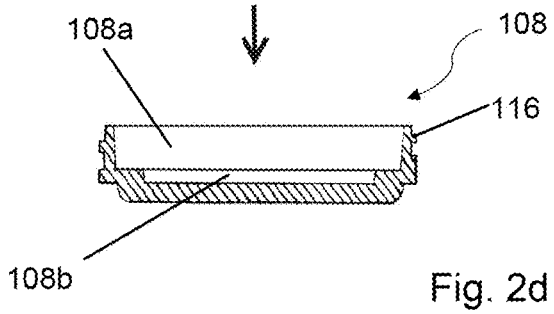
FIG. 2*d* shows a cross-sectional view of the container.

FIG. 2*c* exemplifies a cross-sectional view of the sponge 106, illustrating its sponge cavity 107 which has the shape of an inverted conical frustum. In other words, the cavity 107 has a larger upper diameter and a smaller lower diameter, such that the sidewalls taper inwardly from top to bottom. The sponge cavity 107 is wider at the top opening and gradually narrows toward the bottom, enhancing liquid retention and dispensing capabilities. In other embodiments of the hand sanitizer sponge 100, the sponge cavity 107 may have a cylindrical shape or a conical frustum. The sponge 106 comprises a conical frustum part 106*b* and a cylindrical part 106*a* at its base.

FIG. 2*d* exemplifies a cross-sectional view of the container 108, showing the container external male screw threads 116 with a hollow interior chamber 108*a* designed to hold the liquid 110. The hollow interior is comprised of the chamber 108*a*, wherein cylindrical part of the sponge 106*a* sits, and the depression 108*b*.

Figure 3:
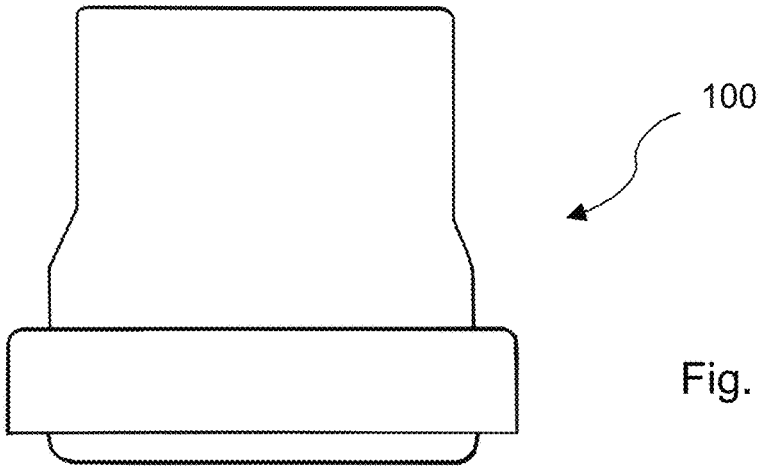
FIG. 3 shows a side view of an embodiment of the hand sanitizer sponge.

FIG. 3 exemplifies a side view of an embodiment of the hand sanitizer sponge 100 in its assembled state. When assembled, the hand sanitizer sponge 100 forms a compact, hermetically sealed unit suitable for portable use.

Figure 4:
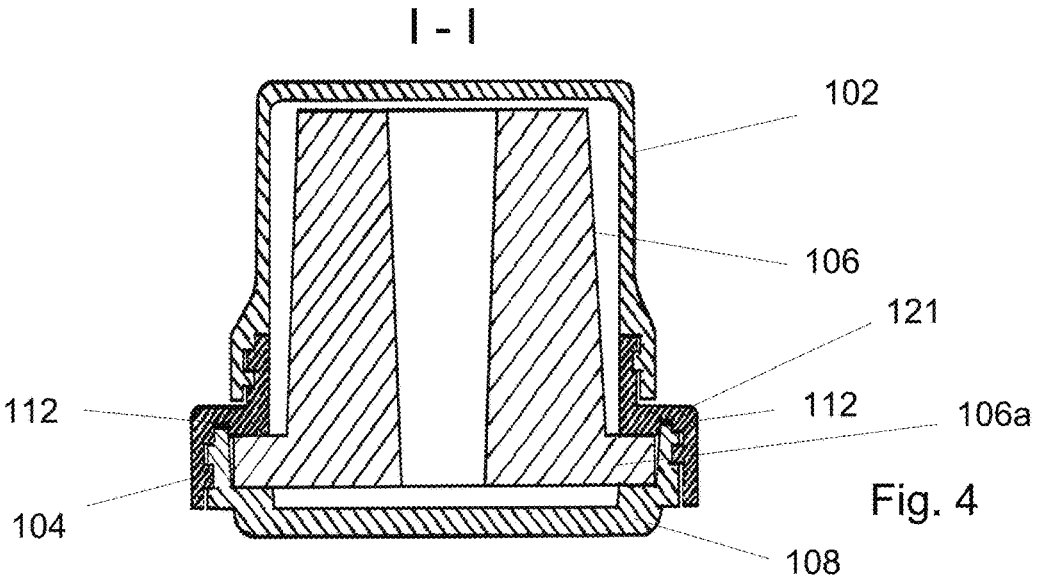
FIG. 4 shows a side cross-sectional view of an embodiment of the hand sanitizer sponge, cut across line I-I.
Figure 5:
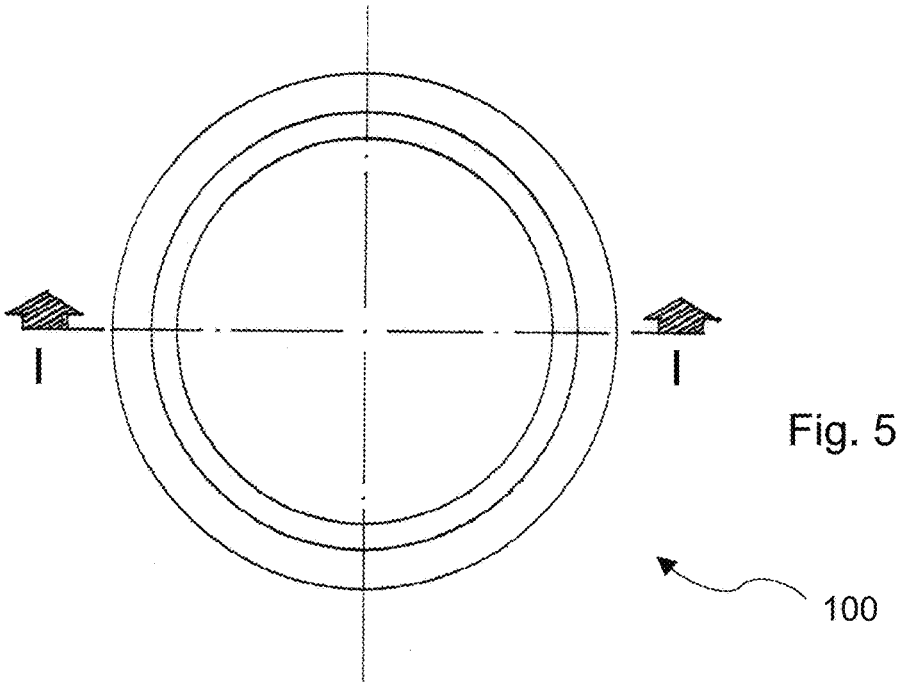
FIG. 5 shows a top view of an embodiment of the hand sanitizer sponge.

FIG. 4 exemplifies a side cross-sectional view of an embodiment of the hand sanitizer sponge 100 along the cut line I-I as shown in FIG. 5. The sponge 106 is retained in the hand sanitizer sponge 100 by the following mechanism: the cylindrical part 106*a* of the sponge 106 is seated in the chamber 108*a* of the container 108, wherein the diameter of the chamber 108*a* is close to the diameter of the cylindrical part 106*a*, so the sponge 106 tightly sits in the container 108. The sleeve 104, by being screwed onto the container 108, keeps the sponge 106 in position by contacting the upper part of the cylindrical part 106*a*. The sleeve rubber ring 112, seated in the groove 121, creates a hermetic seal when the sleeve 104 is screwed onto the container 108. Thus, the sponge 106 is fixed in position between the container 108 and the sleeve 104. When the lid 102 is screwed onto the sleeve 104 by engaging the lid internal female screw threads 122 with the sleeve external male screw threads 120, the conical frustum part 106*b* is completely encapsulated, and the hand sanitizer sponge 100 is fully closed and hermetically sealed.

FIG. 5 exemplifies a top view of an embodiment of the hand sanitizer sponge 100. From this perspective, the circular configuration of the device is visible, demonstrating its compact design suitable for various attachment methods.

Figure 6:
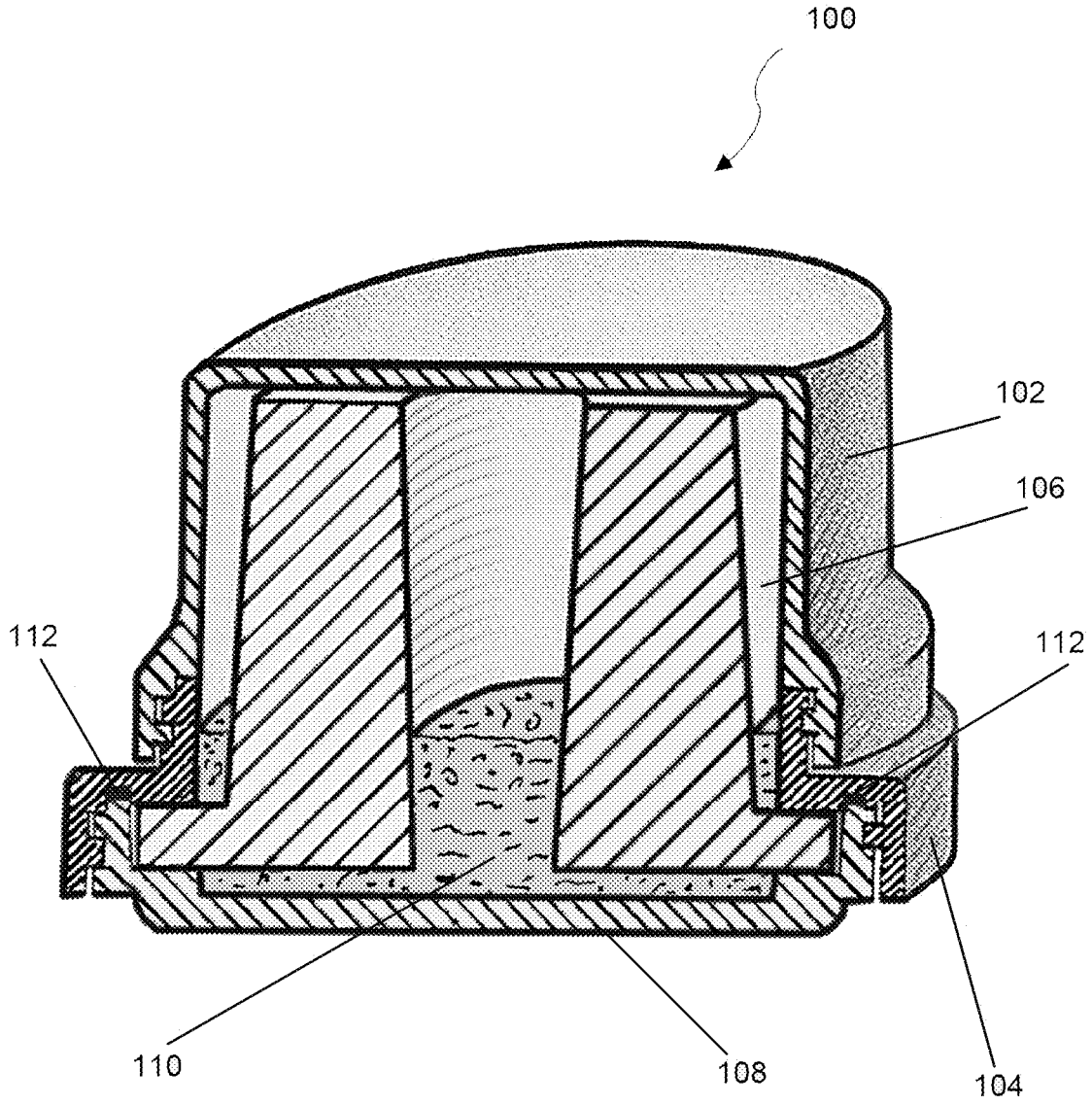
FIG. 6 shows an elevated right perspective view of an embodiment of the hand sanitizer sponge.

FIG. 6 exemplifies an elevated right perspective view of an embodiment of the hand sanitizer sponge 100 filled with the liquid 110, such as a disinfecting liquid. The assembled device shows the relationship between the lid 102, sleeve 104, and container 108 when fully assembled. It also shows, up to which level the liquid 110 is recommended to be filled so the hand sanitizer sponge 100 retains its hermeticity.

Figure 7:
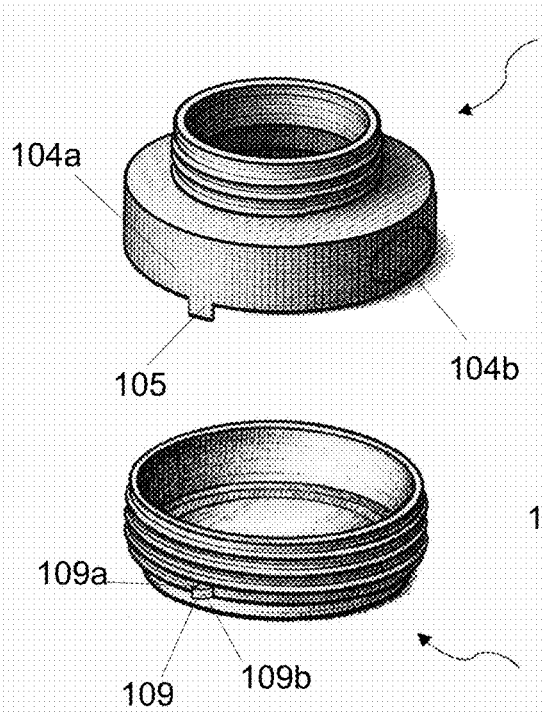
FIG. 7 shows elevated perspective views of the sleeve and the container.

FIG. 7 exemplifies elevated perspective views of the sleeve 104 and container 108. One embodiment of the hand sanitizer sponge 100 may incorporate a child-proof locking mechanism comprising the sleeve lug 105 on the sleeve 104 and the container lug 109 on the container 108. The sleeve 104 also shows a sleeve surface 104*a*. The child-proof mechanism operates as follows: when screwing the sleeve 104 onto the container 108 in a clockwise direction, at a certain point the sleeve lug 105 begins to slide over the container lug 109. The container lug 109 has a specific structure featuring a ramp surface 109*b* that gradually elevates in a clockwise direction, and then terminates abruptly with a stop surface 109*a*, which forms a 90-degree angle relative to the container external male screw threads 116. As the sleeve 104 is tightened, the sleeve lug 105 climbs over the ramped portion, ramp surface 109*b* of the container lug 109, and when it passes over the highest point, it drops down and returns to its normal position relative to the threads 116. When a child attempts to unscrew the sleeve 104 from the container 108, by rotating the sleeve 104 anti-clockwise, the sleeve lug 105 becomes blocked by the stop surface 109*a* of the container lug 109. To enable the sleeve lug 105 to clear the stop surface 109*a* of the container lug 109, the distance between the sleeve lug 105 and the threads 116 must be increased so that the sleeve lug 105 can overcome the height of the container lug 109. This is achieved by temporarily deforming the circular shape of the sleeve surface 104*a* into an elliptical shape. By applying opposing pressure at two points on the sleeve surface 104*a*—specifically at points positioned 90 degrees from the sleeve lug 105 location, such as the sleeve deforming area 104*b*, and its directly opposite point—the user creates an elliptical deformation. This deformation causes the distance between the sleeve lug 105 and the opposite side to increase, allowing sufficient clearance for the sleeve lug 105 to pass over the stop surface 109*a* of the container lug 109. This coordinated action of squeezing and turning simultaneously is difficult for young children to perform.

Figure 8:
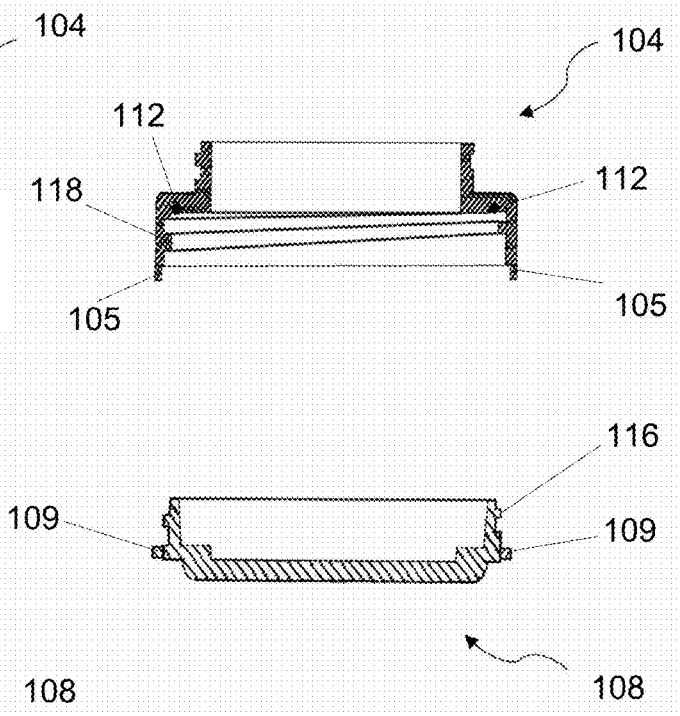
FIG. 8 shows side cross-sectional views of the sleeve and the container.

FIG. 8 exemplifies side cross-sectional views of the sleeve 104 and container 108. The sleeve internal female screw threads 118 of the sleeve 104 are shown in relation to the container external male screw threads 116 of the container 108. The sleeve rubber ring 112 is positioned to create a hermetic seal when the components are assembled. In some embodiments, the child-proof mechanism may include two sleeve lugs 105 on the sleeve 104 and two corresponding container lugs 109 on the container 108. When multiple lugs are present, they are positioned diametrically opposite to each other-meaning one sleeve lug 105 is positioned 180 degrees opposite to the other sleeve lug 105 on the sleeve 104, and similarly, one container lug 109 is positioned 180 degrees opposite to the other container lug 109 on the container 108. This opposing configuration ensures balanced force distribution during the squeezing action required to operate the child-proof mechanism.

Figure 9:
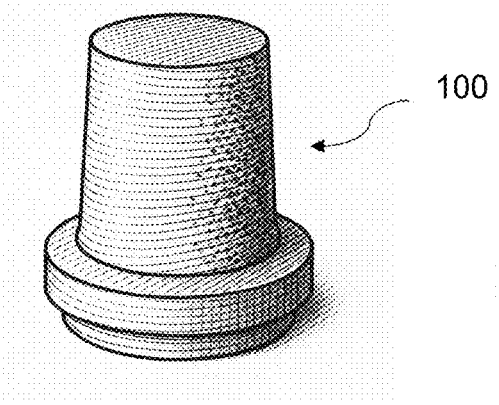
FIG. 9 shows an elevated left perspective view of an embodiment of the hand sanitizer sponge.

FIG. 9 exemplifies an elevated left perspective view of an embodiment of the hand sanitizer sponge 100.

Figure 10:
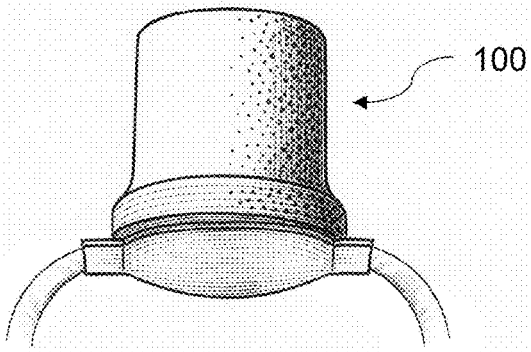
FIG. 10 shows a bottom side perspective view of an embodiment of the hand sanitizer sponge having a wristband.

FIG. 10 exemplifies a bottom side perspective view of an embodiment of the hand sanitizer sponge 100 having a wristband. The device can be attached to a watchband, allowing users to carry the sanitizer on their wrist for immediate access whenever needed.

Figure 11:
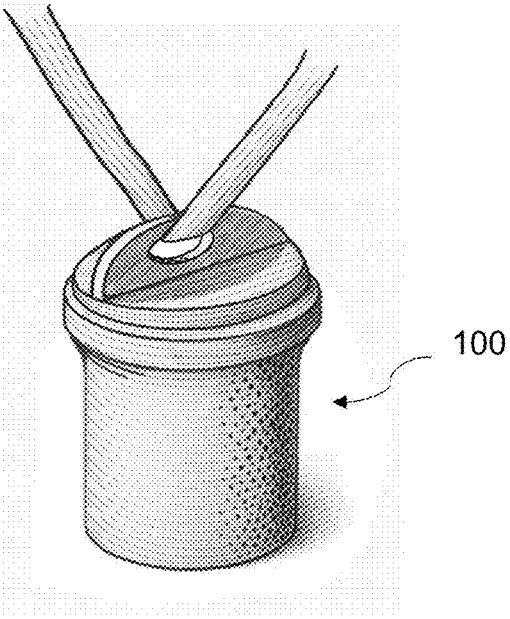
FIG. 11 shows an elevated left perspective view of an embodiment of the hand sanitizer sponge having a lanyard hole.

FIG. 11 exemplifies an elevated left perspective view of an embodiment of the hand sanitizer sponge 100 having a lanyard hole. The lanyard attachment allows the device to be worn around the neck, providing convenient access in medical facilities, schools, or other environments where frequent hand sanitization is required.

Figure 12:
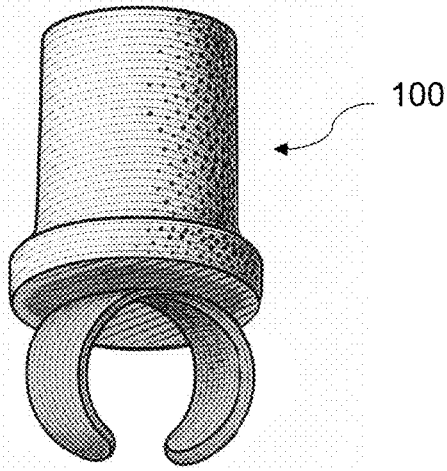
FIG. 12 shows a bottom side perspective view of an embodiment of the hand sanitizer sponge having a finger ring.

FIG. 12 exemplifies a bottom side perspective view of an embodiment of the hand sanitizer sponge 100 having a finger ring. The ring attachment allows the device to be worn on a finger, providing the most immediate access for frequent use scenarios.

Figure 13:
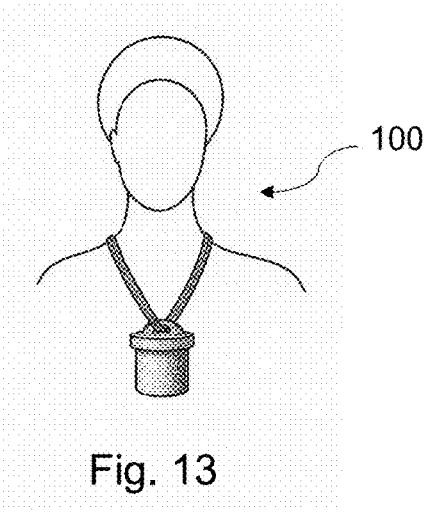
FIG. 13 shows a frontal view of an embodiment of the hand sanitizer sponge hanging from a user's neck.

FIG. 13 exemplifies a frontal view of an embodiment of the hand sanitizer sponge 100 hanging from the user's neck. When worn with a lanyard, the device remains easily accessible while keeping the user's hands free for other activities.

Figure 14:
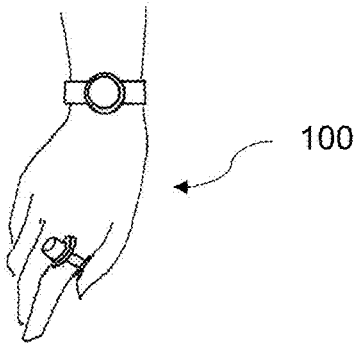
FIG. 14 shows a top view of the user's hand having on the wrist and finger embodiments of the hand sanitizer sponge.

FIG. 14 exemplifies a top view of the user's hand having embodiments of the hand sanitizer sponge 100 on both the wrist and finger. Multiple devices can be worn simultaneously for users who require frequent sanitization in high-risk environments.

Figure 15:
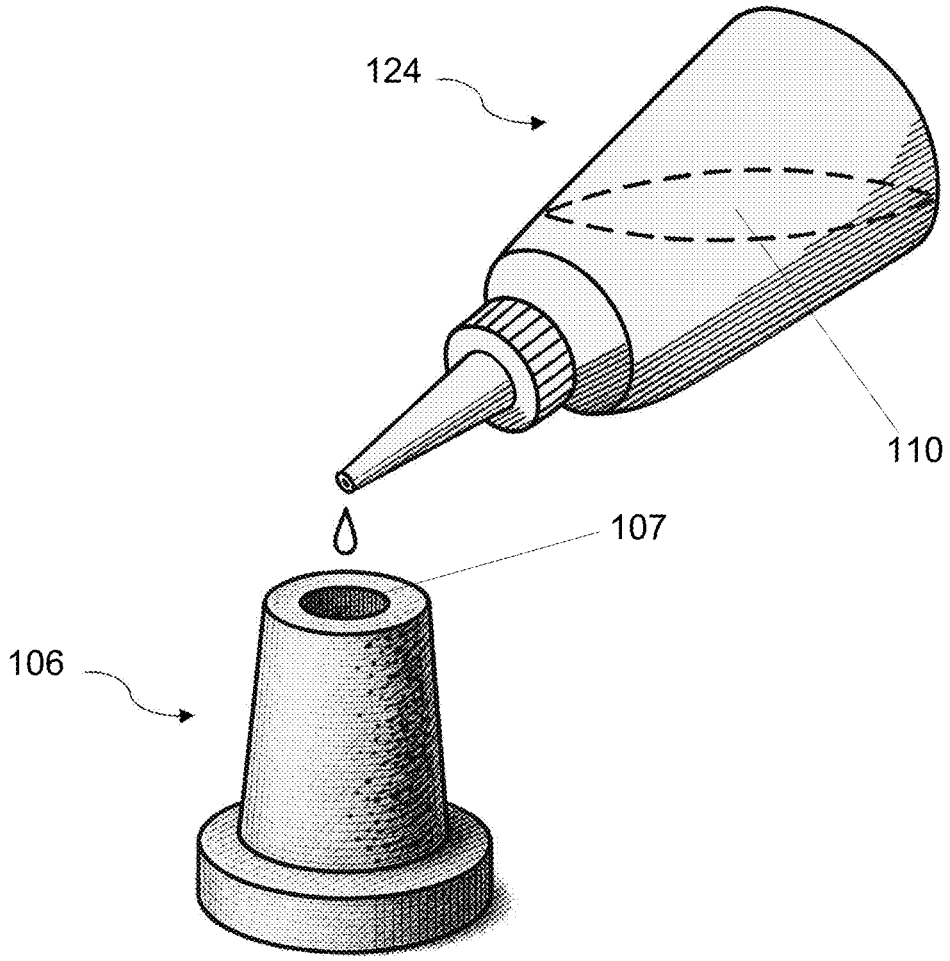
FIG. 15 shows a perspective view of a squeeze bottle dropping liquid into the sponge internal cavity.

FIG. 15 exemplifies a perspective view of a squeeze bottle 124 dropping liquid 110 into the sponge cavity 107. The inverted conical frustum shape of the sponge cavity 107 facilitates easy filling, as the wider top opening allows for accurate pouring while the narrowing cavity helps distribute the liquid 110 throughout the sponge 106. The liquid 110 may filled through the top opening of the container 108 to a level where the entire sponge 106 is saturated with disinfectant, sanitizer. The squeeze bottle 124 allows for controlled filling without spillage.

The hand sanitizer sponge 100 is designed to be used in places of mass gatherings, shops, malls, during traveling, in hospitals or any medical facilities, by personnel of schools and kindergartens, during epidemics, during the provision of emergency aid, and in any other situation where hand hygiene is critical.

Besides its primary function of disinfecting hands, the hand sanitizer sponge 100 can be utilized for additional purposes. The moistened sponge 106 can assist in opening plastic bags that are typically attached to each other, making it easier to separate individual bags. During cash handling operations, the device provides moisture to fingertips, improving grip and counting accuracy. For reading or studying, the device can be used for turning pages of books, magazines, or documents without leaving moisture marks.

The materials used in construction of the hand sanitizer sponge 100 are selected for their compatibility with various sanitizing solutions. The container 108, sleeve 104, and lid 102 may be manufactured from different types of plastics such as polypropylene, polyethylene, or other chemical-resistant polymers. Alternatively, except for the sponge 106, all components including the container 108, sleeve 104, and lid 102 may be manufactured from metal materials such as aluminum, stainless steel, or other corrosion-resistant alloys. Other materials suitable for the above-mentioned application of the hand sanitizer sponge 100 may also be used. The sponge 106 is made from materials that can absorb and retain sanitizing liquids while maintaining their structural integrity over repeated use. The sleeve rubber ring 112 is made from elastomeric materials that provide effective sealing while being resistant to alcohol-based sanitizers.

The portable nature of the hand sanitizer sponge 100, combined with its multiple attachment options, ensures that users always have access to hand sanitization when needed. The hermetic sealing system maintains the effectiveness of the sanitizing liquid 110 over extended periods, making the device suitable for emergency preparedness kits, travel accessories, or daily use in high-contact environments.

What is claimed is:

1. A hand sanitizer sponge device comprising:

a container for holding a sanitizing liquid;

a sponge for retaining the sanitizing liquid;

a sleeve having a central opening through which the sponge extends; and a lid for covering the sponge;

wherein the sleeve is threaded onto the container, and the lid is threaded onto the sleeve;

wherein the sleeve includes sleeve internal female screw threads engaging with container external male screw threads;

wherein the lid includes lid internal female threads engaging with the sleeve external male threads;

further comprising a rubber sealing ring positioned in between the sleeve and the container;

wherein the rubber ring sits in a groove located within an interior section of the sleeve;

wherein the sponge includes a sponge cavity;

wherein the sponge cavity has shape of an inverted conical frustum; and wherein the sponge comprises an upper conical frustum part integrally joined to a lower cylindrical part, the lower cylindrical part having a diameter greater than the diameter at the base of the upper conical frustum part, and the diameter of the sponge is continuously increasing from top to down.

2. The hand sanitizer sponge device of claim 1, wherein the lower cylindrical part is dimensioned to tightly fit within a chamber of the container.

3. The hand sanitizer sponge device of claim 1, further comprising a child-proof locking mechanism comprising at least one sleeve lug on the sleeve and at least one container lug on the container.

4. The hand sanitizer sponge device of claim 3, wherein the container lug comprises a ramp surface and a stop surface.

5. The hand sanitizer sponge device of claim 3, wherein two sleeve lugs are positioned diametrically opposite to one another on the sleeve and two container lugs are positioned diametrically opposite to one another on the container.

* * * * *